US005540583A

United States Patent [19]

Keller et al.

[11] Patent Number: 5,540,583

[45] Date of Patent: Jul. 30, 1996

[54] FUEL COMBUSTION EXHIBITING LOW $NO_x$ AND CO LEVELS

[76] Inventors: Jay O. Keller, 3534 Brunell Dr., Oakland, Calif. 94602; T. Tazwell Bramlette, 2105 Canyon Lakes Dr., San Ramon, Calif. 94583; Pamela K. Barr, 294 Joyce St., Livermore, Calif. 94550

[21] Appl. No.: 210,794

[22] Filed: Mar. 17, 1994

[51] Int. Cl.[6] ..... F23C 5/00

[52] U.S. Cl. ..... 431/8; 431/10; 431/12; 431/1; 431/116; 431/172

[58] Field of Search ..... 431/8, 1, 12, 10, 431/116, 172

[56] References Cited

U.S. PATENT DOCUMENTS

| | | | |
|---|---|---|---|
| 3,667,451 | 6/1972 | Boucher | 126/110 R |
| 4,309,977 | 1/1982 | Kitchen | 126/99 |
| 4,484,885 | 11/1984 | Machii | 431/1 |
| 4,687,435 | 8/1987 | Matsuzaka | 431/1 |
| 4,752,209 | 6/1988 | Vishwanath et al. | 431/1 |
| 4,856,981 | 8/1989 | Flanagan | 431/1 |
| 4,926,798 | 5/1990 | Kardos | 122/24 |
| 4,938,203 | 7/1990 | Thrasher et al. | 126/110 |
| 4,955,805 | 9/1990 | Ishiguro et al. | 431/1 |
| 5,015,171 | 5/1991 | Zinn et al. | 431/1 |
| 5,020,987 | 6/1991 | Ishiguro et al. | 431/1 |
| 5,118,281 | 6/1992 | Bramlette et al. | 431/1 |
| 5,281,128 | 1/1994 | Dalla Betta et al. | 431/7 |

OTHER PUBLICATIONS

J. O. Keller, et al., "$NO_x$ and CO Emissions from a Pulse Combustor Operating in a Lean Premixed Mode", Mar. 22–23, 1993.

Belles and Michel, "Development and Commercialization of a 5–Million Btu/hr Pulse Combustion Commercial/Industrial Steam Boiler with Modulation Capabilities," Gas Research Inst., Jan. 1993, p. 23.

"Boiler with Modulation Capabilities," Gas Research Inst., Jan. 1993, p. 23.

*Primary Examiner*—Larry Jones

*Attorney, Agent, or Firm*—Timothy D. Stanley; Gregory A. Cesme; Donald A. Nissem

[57] ABSTRACT

Method and apparatus for safely combusting a fuel in such manner that very low levels of $NO_x$ and CO are produced. The apparatus comprises an inlet line (12) containing a fuel and an inlet line (18) containing an oxidant. Coupled to the fuel line (12) and to the oxidant line (18) is a mixing means (11,29,33,40) for thoroughly mixing the fuel and the oxidant without combusting them. Coupled to the mixing means (11,29,33,40) is a means for injecting the mixed fuel and oxidant, in the form of a large-scale fluid dynamic structure (8), into a combustion region (2). Coupled to the combustion region (2) is a means (1,29,33) for producing a periodic flow field within the combustion region (2) to mix the fuel and the oxidant with ambient gases in order to lower the temperature of combustion. The means for producing a periodic flow field can be a pulse combustor (1), a rotating band (29), or a rotating cylinder (33) within an acoustic chamber (32) positioned upstream or downstream of the region (2) of combustion. The mixing means can be a one-way flapper valve (11); a rotating cylinder (33); a rotating band (29) having slots (31) that expose open ends (20,21) of said fuel inlet line (12) and said oxidant inlet line (18) simultaneously; or a set of coaxial fuel annuli (43) and oxidizer annuli (42,44). The means for producing a periodic flow field (1, 29, 33) may or may not be in communication with an acoustic resonance. When employed, the acoustic resonance may be upstream or downstream of the region of combustion (2).

30 Claims, 6 Drawing Sheets

FUEL COMBUSTION EXHIBITING LOW $NO_X$ AND CO LEVELS

STATEMENT OF GOVERNMENTAL INTEREST

The government has rights in this invention pursuant to contract no. DE-AC-04-76-DP00789 awarded by the U.S. Department of Energy to Sandia Corporation.

TECHNICAL FIELD

This invention pertains to the field of combusting fuel in a safe manner, while advantageously minimizing the production of nitrogen gases ($NO_x$) and carbon monoxide (CO).

BACKGROUND ART

Keller et. al., "$NO_x$ and CO Emissions from a Pulse Combustor Operating in a Lean Premixed Mode", Western States Section/The Combustion Institute 1993 Spring Meeting, University of Utah, Salt Lake City, Utah, Mar. 22–23, 1993, discloses portions of the pulse combustor embodiment of the present invention. This paper, however, contains data points for carbon monoxide which are incorrect. A corrected, as yet unpublished, version of this paper is appended to this specification as Appendix A, and is expressly incorporated by reference herein.

Keller et al., "Safe and Benign Controlled Premixed Burner Design Resulting in Ultra-Clean Combustion of Gaseous Fuels for Residential, Commercial, Industrial and Utility Applications" is another unpublished paper giving further background and details of the present invention. Said paper is appended to this specification as Appendix B, and is also expressly incorporated by reference herein.

Belles et al., "Development and Commercialization of a 5 million BTU/hr Pulse Combustion Commercial/Industrial Steam Boiler with Modulating Capabilities", Final Report for Gas Research Institute, Contract No. 5087-295-1548, January 1993, relates generally to the subject matter of this patent application. See in particular page 23, which discusses "quasi-premixed operation", and FIG. 22. In contrast with the present invention, the apparatus shown in FIG. 22 shows separate flapper valves for the air and the gas. These valves do not close at the same time; therefore, it is not possible to control the equivalence ratio as it is in the present invention.

Also see U.S. Pat. Nos. 5,118,281; 5,020,987; 4,955,805; 4,938,203; 4,926,798; 4,856,981; 4,752,209; 4,687,435; 4,484,885; 4,309,977; and U.S. Pat. No. 3,667,451.

DISCLOSURE OF INVENTION

The present invention is a method for safely combusting fuel while achieving low levels of $NO_x$ and CO. The method comprises the steps of thoroughly mixing a fuel and an oxidant without combusting them. The mixed fuel and oxidant are injected (4) into a region (2) where combustion occurs. The injected mixture has the form of a large-scale fluid dynamic structure (8). This enables macroscopic mixing of the fuel and the oxidant, as created by the injection profile and the associated geometry. The flow field within the combustion region (2) is time-varied in order to temporarily control the mixing characteristics of the premixed reactants (fuel and oxidant) with the ambient fluid in the combustion chamber (2). Controlling the rate and character of the rapid and thorough mixing of the ambient fluid with the premixed reactants allows the combustion characteristics to be modified to optimize a desired process. One such process is to minimize the emission of harmful pollutants without the sacrifice of efficiency; another is to maximize oxidation of hazardous organic compounds.

These and other more detailed and specific objects and features of the present invention are more fully disclosed in the following specification, reference being had to the accompanying drawings, in which:

DETAILED DESCRIPTION OF THE PREFERRED EMBODIMENTS

Figure 1:
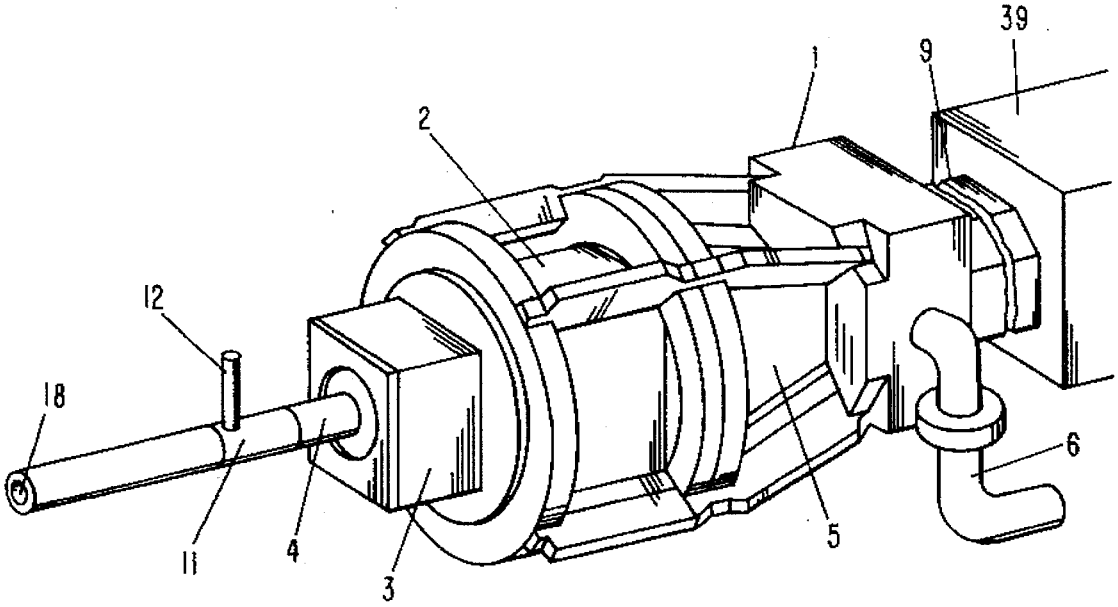
FIG. 1 is an isometric view of a pulse combustor 1 using the present invention.

FIG. 1 shows a first embodiment of the present invention using a Helmholtz-type pulse combustor 1. A fuel and an oxidant are combusted within combustion chamber 2. The gaseous flow field within chamber 2 is time-varied by pulsing the combustion. A tailpipe 9 has a smaller cross-section than that of chamber 2. A contraction section 5 transitions between chamber 2 and tailpipe 9. Expansion terminator 39 has a larger cross-section than that of tailpipe 9. Gases are allowed to expel through cooling exhaust pipe 6.

In the present invention, mixing chamber 3 of pulse combustor 1 is not used. Rather, premixed fuel and oxidant are fed into combustion chamber 2 via intake port 4. The mixing is accomplished by providing a one-way valve comprising a barrier. Upstream of the barrier, the fuel and the oxidant do not mix. Downstream of the barrier, the fuel and the oxidant are allowed to mix in a mixing region that is upstream of chamber 2. FIG. 1 illustrates the embodiment of the present invention in which the one-way valve is a flapper valve 11 inserted axially along the intake port 4. The geometry does not have to be axi-symmetric. The gaseous flow fields are time-varying all the way from valve 11 to expansion terminator 39. Periodic pulsing of the combustion combined with careful selection of the geometry of the components within pulse combustor 1 creates a condition of acoustic resonance within combustor 1, i.e., a pattern of oscillatory standing waves of the gases within combustor 1. This advantageously increases the rates of heat, mass, and momentum transfer.

The fuel is introduced through fuel port 12. Oxidant is introduced through oxidant port 18. The fuel can be any gaseous fuel such as methane, natural gas, or propane. The oxidant can be air. A lean fuel/oxidant equivalence ratio is used.

Figure 2:
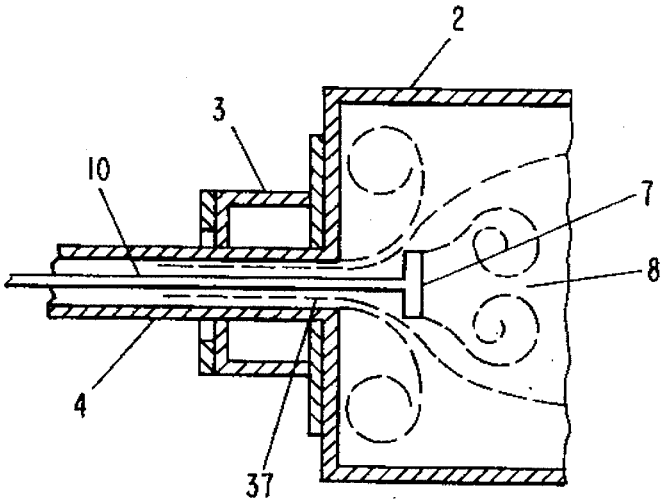
FIG. 2 is an enlarged side cross-sectional view of a portion of FIG. 1.

FIG. 2 shows that preferably a stagnation plate 7 is placed within combustion chamber 2 near the entrance 37 thereof. The stagnation plate 7 can be as described in U.S. Pat. No. 5,118,281. Plate 7 is fixedly mounted at the end of an elongated rod 10 that is coaxially disposed within intake port 4. Plate 7 helps to create a large-scale fluid dynamic structure 8 (as this term is conventionally used in the fluid dynamics art) within combustion chamber 2. This large-scale fluid dynamic structure 8 advantageously enhances the rapid macroscopic mixing of the fuel and the oxidant within chamber 2. Preferably, the fluid dynamic structure 8 has the form of a coherent vortex, such as a toroidal vortex. The flow field within combustion region 2 is time-varied in order to mix the premixed fuel and oxidant with the ambient gases, e.g., the products of combustion, to enhance the rate of mixing, advantageously controlling the combustion fluid dynamics to optimize the desired process. The time-varying may be periodic, i.e., oscillatory.

Figure 3:
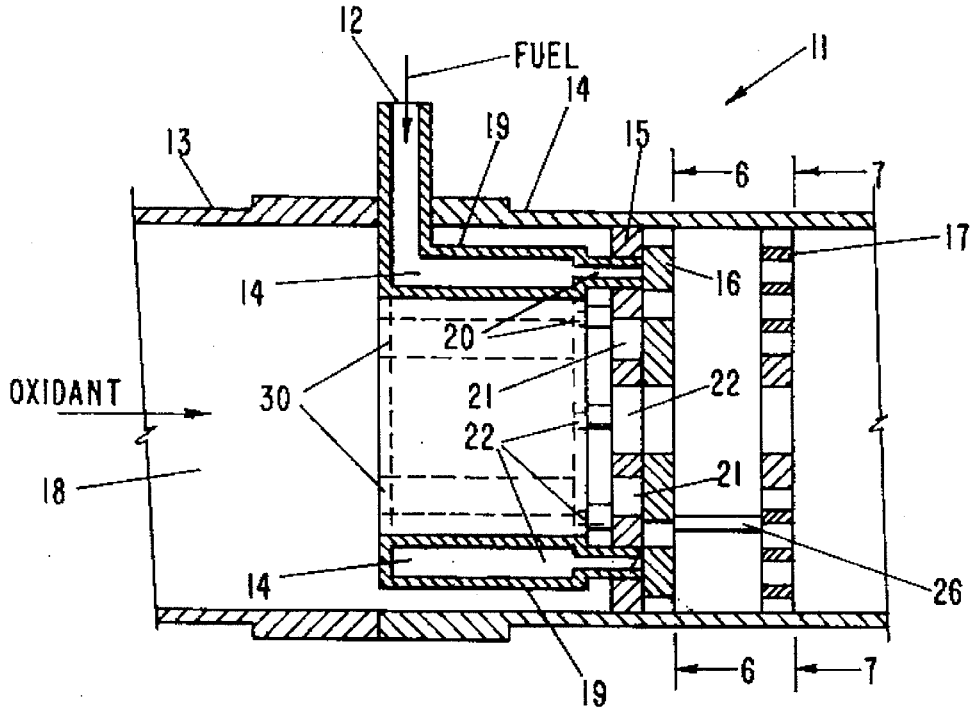
FIG. 3 is a side cross-sectional view of a flapper valve 11 used in conjunction with the present invention, in which valve 11 is closed.
Figure 4:
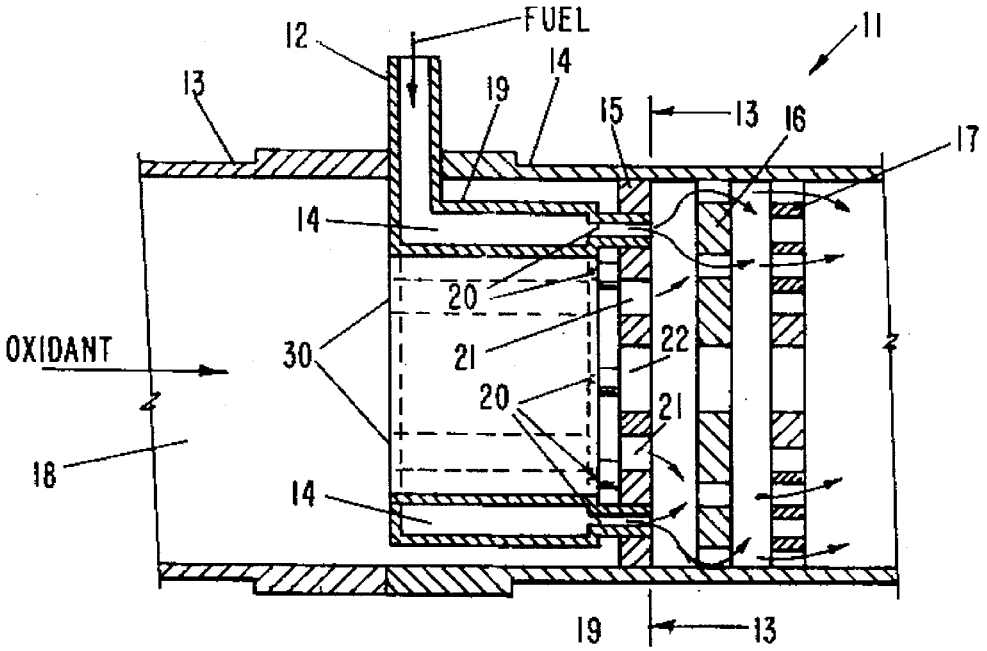
FIG. 4 is a side cross-sectional view of a flapper valve 11 used in conjunction with the present invention, in which valve 11 is partially open.
Figure 5:
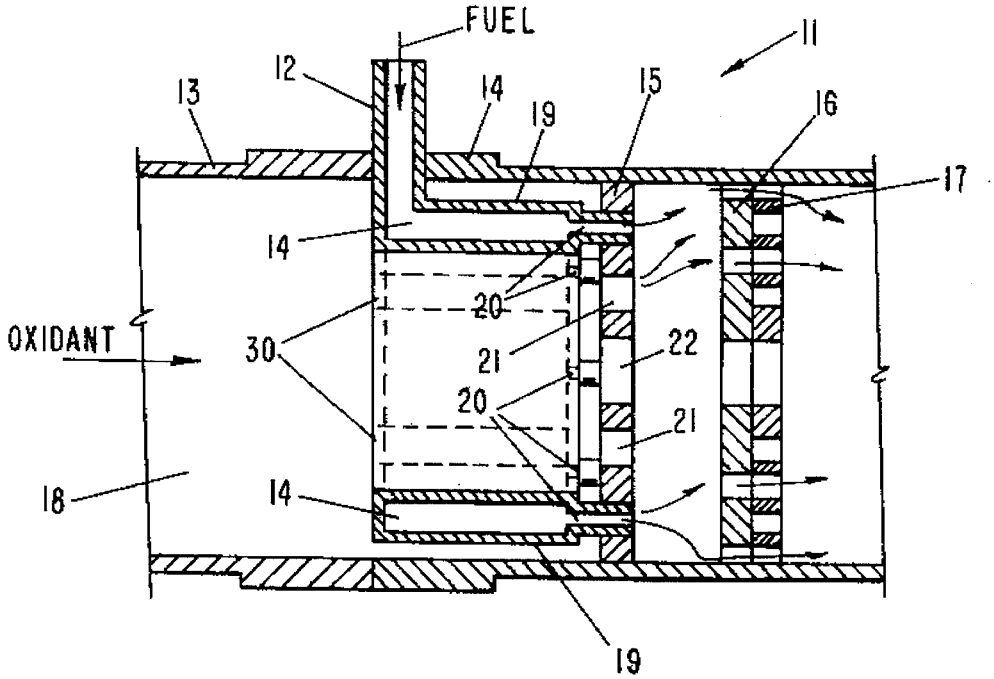
FIG. 5 is a side cross-sectional view of a flapper valve 11 used in conjunction with the present invention, in which valve 11 is open.

FIGS. 3–7 and 13 illustrate a first embodiment of the mixing means in which the mixing means is a one-way flapper valve 11. A flapper 16 is free to move axially between a valve seat 15 located upstream of flapper 16 and a backer plate 17 located downstream of flapper 16. Flapper 16 is made of a non-porous material such as Teflon. Backer plate 17 is fixedly spaced apart from the valve seat 15. The distance of this spacing is selected based upon flow rate requirements. Opening the flapper 16 causes fuel holes 20 and oxidant holes 21 to open simultaneously. Closing the flapper 16 causes the fuel holes 20 and the oxidant holes 21 to close simultaneously. The simultaneity feature is important, because it enables the fuel/oxidant equivalence ratio to be precisely controlled. Preferably, there are many fuel holes 20 and many oxidant holes 21, to enhance the mixing process. In the illustrated embodiment, the fuel holes 20 are smaller than the oxidant holes 21, but this is not necessary. FIG. 3 shows flapper valve 11 in the closed position. FIG. 4 shows flapper valve 11 in the partially open position. FIG. 5 shows flapper valve 11 in the open position.

Figure 6:
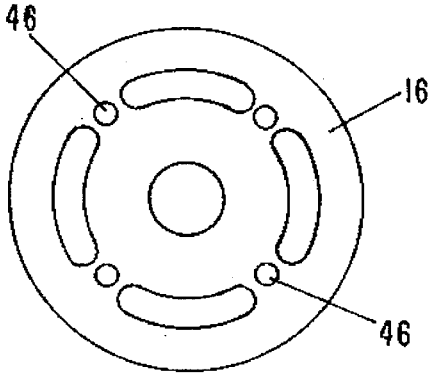
FIG. 6 is an end view of a flapper 16 used in conjunction with flapper valve 11.
Figure 7:
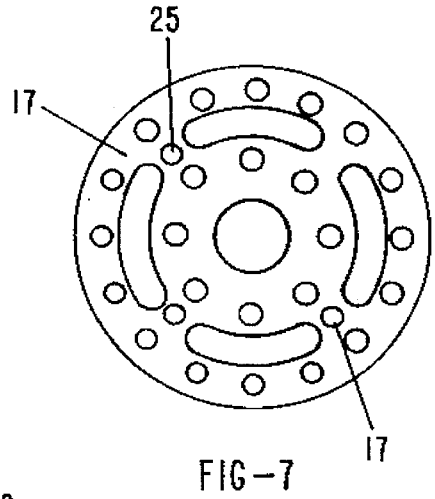
FIG. 7 is an end view of a backer plate 17 used in conjunction with flapper valve 11.
Figure 13:
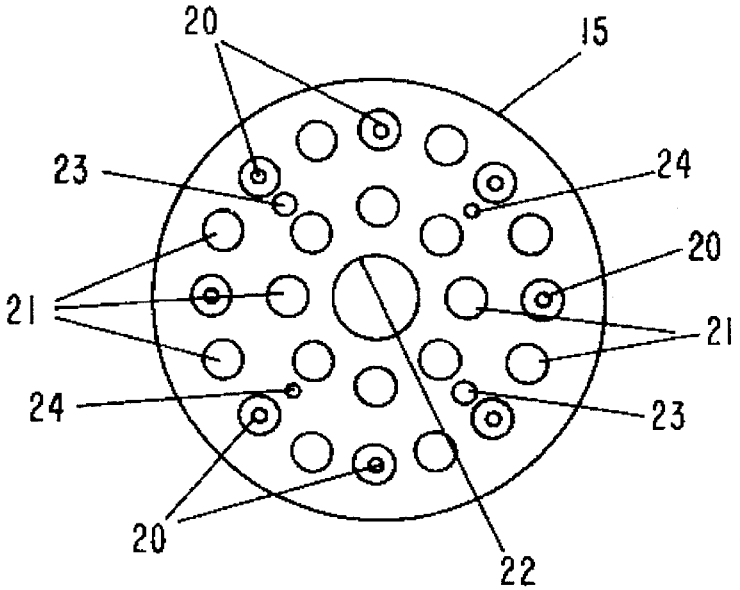
FIG. 13 is an end view of a valve seat 15 used in flapper valve 11.

Backer plate 17 contains apertures to communicate to flapper 16 pressure information from downstream. The apertures in backer plate 17 do not have to be aligned with the apertures in valve seat 15. Valve seat 15 has a relatively large center aperture 22 to accommodate rod 10. Screws 26 (see FIG. 3) are used to space backer plate 17 apart from valve seat 15. Screws 26 pass through apertures 25 in backer plate 17, apertures 46 in flapper 16, and apertures 23 in valve seat 15 (FIGS. 7, 6, 13, respectively). Rigid pins 24 fixedly mounted on valve seat 15 can also be used for spacing purposes (FIG. 13).

Flapper valve 11 may be constructed in two major portions, an upstream housing 13 and a downstream housing 14, for ease of assembly. Tooled within housing 14 is an oxidant manifold 30 and a fuel manifold 19. The purpose of these manifolds 30,19 is to divide the gas flow from the single oxidant input port 18 into many oxidant holes 21, and to divide the gas flow from the single fuel input port 12 into many fuel holes 20, respectively.

By using many fuel holes 20 and oxidant holes 21, the mixing of the fuel and the oxidant is advantageously thorough. Just downstream of backer plate 17 and flapper valve 11, the fuel and the oxidant are thoroughly mixed.

Figure 8:
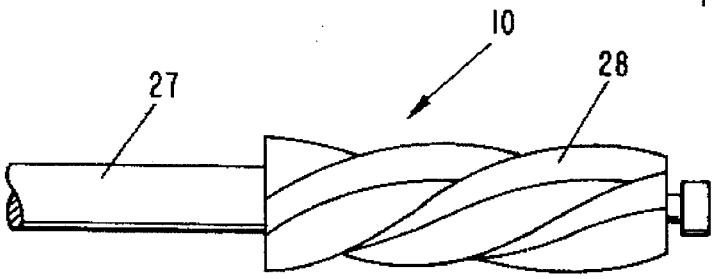
FIG. 8 is a side view of rod 10 used in conjunction with the present invention.

FIG. 8 shows an exemplary center rod 10. The upstream end 27 of rod 10 may be threaded so as to fit within rod opening 22 within valve seat 15. The downstream end of rod 10 may be a swirl 28. By this device, a series of helical paths is inserted within intake port 4. This advantageously introduces more vorticity in the axial direction, which breaks down the fluid dynamic structure 8 more quickly to enhance the microscopic mixing. Swirl 28 does not need to rotate. Rather than using a static swirl 28, a time-varying (dynamic) swirl could be used within intake port 4.

Figure 9:
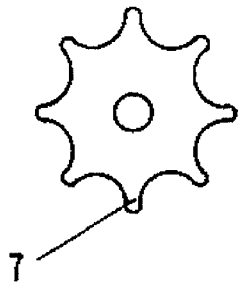
FIG. 9 is an end view of a first embodiment of a stagnation plate 7 used in the present invention.
Figure 10:
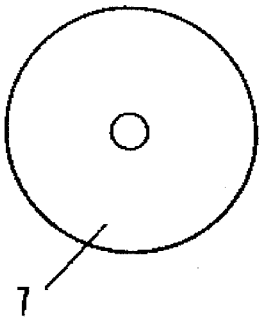
FIG. 10 is an end view of a second embodiment of a stagnation page 7 used in the present invention.

FIGS. 9 and 10 illustrate two embodiments of stagnation plate 7. In FIG. 10, plate 7 has the shape of a flat washer. In FIG. 9, plate 7 has the shape of a star. The number of star points is selected based upon the natural breakdown eigenvalue of the fluid dynamic structure 8. Compared with the FIG. 10 embodiment, the FIG. 9 embodiment breaks down the fluid dynamic structure 8 more rapidly, thereby increasing the rate of microscopic mixing.

Figure 11:
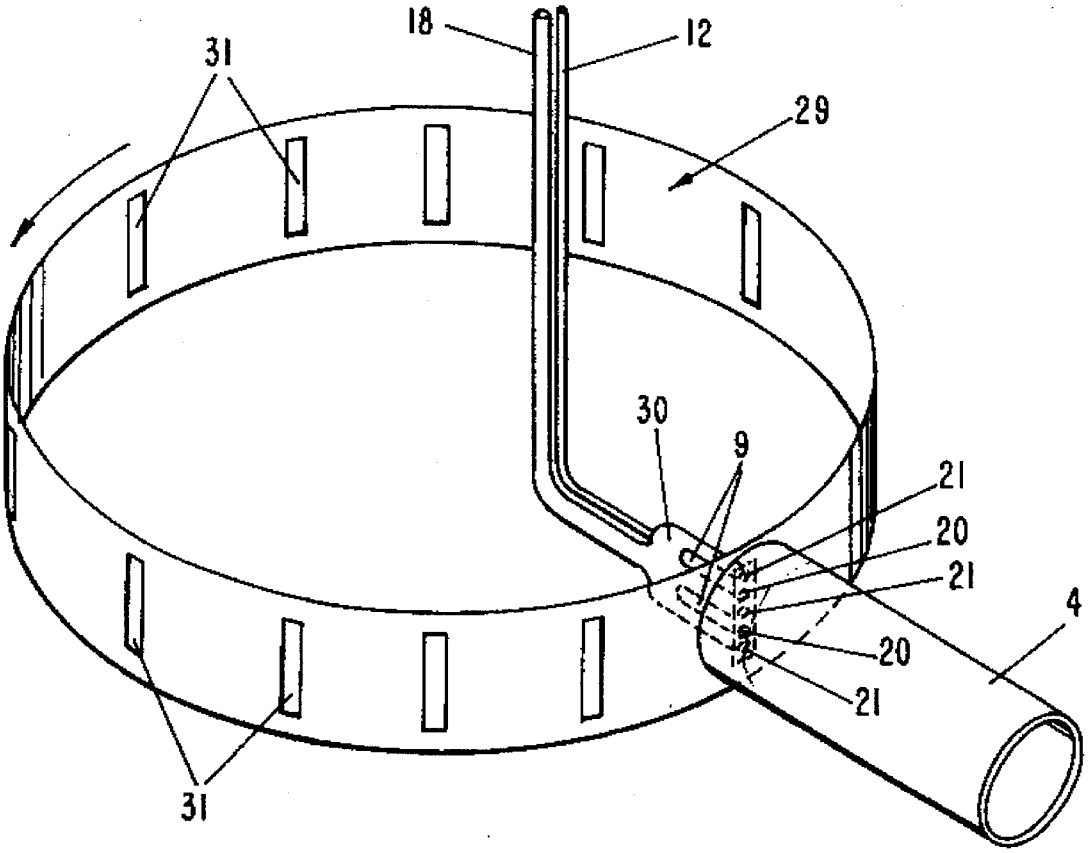
FIG. 11 is an isometric view of a second embodiment of a one-way valve 29 used in the present invention.

An alternative embodiment of the one-way valve mixing means is the mechanical means illustrated in FIG. 11. In this embodiment, the mixing means is a rotating band 29 having many elongated slots 31 cut therefrom. Band 29 is rotated by a motor (not illustrated). A fuel manifold 19 transitions the single fuel input line 12 into several fuel holes 20. Similarly, an oxidant manifold 30 transitions the single oxidant input line 18 into several oxidant holes 21. A large number of holes 20, 21 advantageously increases the amount of mixing, as does alternating fuel holes 20 with oxidant holes 21. Holes 20, 21 are fixedly positioned just inside slots 31 as slots 31 rotate past holes 20, 21. As a result, the fuel and oxidant are simultaneously injected into intake port 4 each time a slot 31 passes over the series of holes 20,21. The pulsing can easily be made to be periodic, by rotating band 29 at a constant speed and by providing an equal spacing between slots 31. A periodic pulse rate combined with a proper selection of geometry of the components within combustor 1 can be used to set up a condition of acoustic resonance. This embodiment illustrates that the time-varying flow field can be created upstream of the combustion chamber 2, as well as downstream as with the conventional pulse combustor 1.

Figure 12:
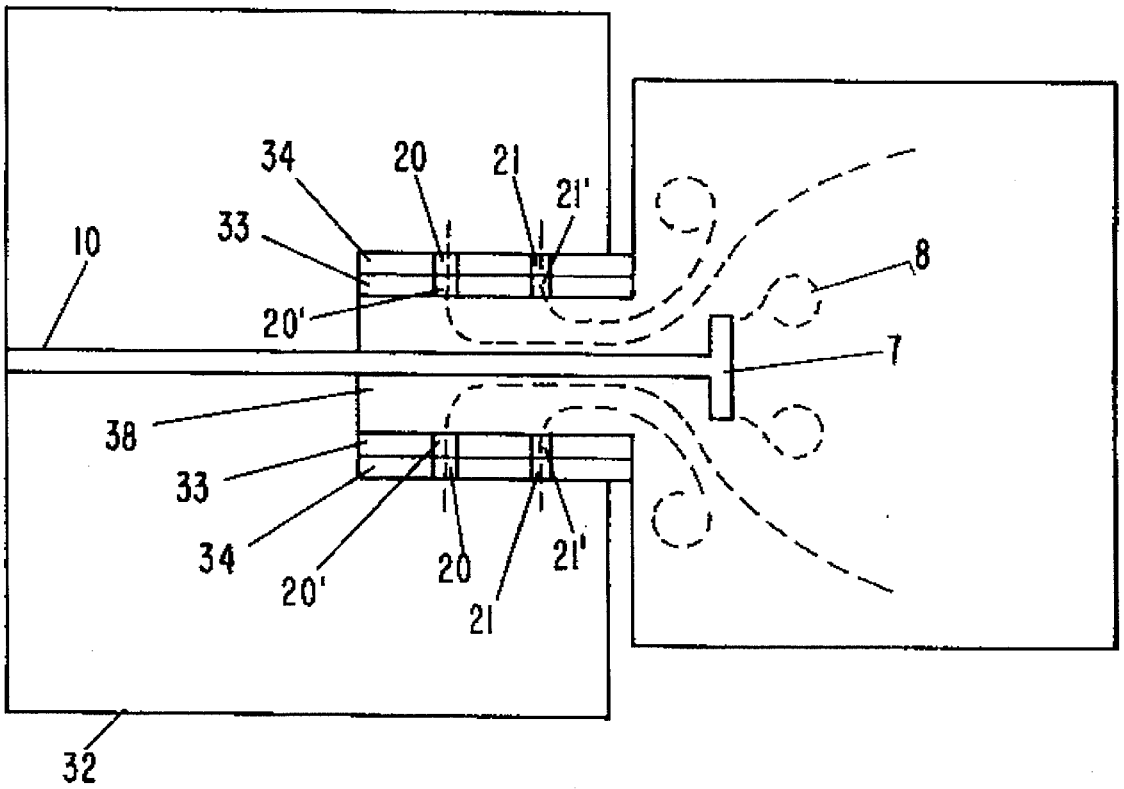
FIG. 12 is a side cross-sectional view of a second embodiment of an acoustic resonance 32 used in the present invention.

FIG. 12 illustrates another embodiment of the present invention in which the flow field is time-varied upstream of the combustion chamber 2. Alternatively, the flow field may be time-varied downstream of the combustion chamber 2. In the embodiment illustrated in FIG. 12, an acoustic chamber 32 is positioned upstream of the combustion chamber 2. Chamber 32 can be dimensioned to create a condition of acoustic resonance, and can be pressurized to enhance the resonant effect. Chamber 32 contains a fixed outer cylindrical sleeve 34 containing fuel holes 20 and oxidant holes 21. Fitting within outer cylindrical sleeve 34 is a rotating inner cylindrical sleeve 33 containing fuel holes 20' and oxidant holes 21' that are longitudinally aligned with holes 20 and 21, respectively. Preferably, a plurality of fuel holes 20 (produced by a fuel manifold) and a plurality of oxidant holes (produced by an oxidant manifold) are utilized, to enhance the mixing process. Sleeve 33 is rotated by a motor (not illustrated). When holes 20 and 20' line up (simultaneously with holes 21 and 21' lining up), the fuel and oxidant are simultaneously passed from acoustic resonator 32 into an upstream-extending zone 38 of combustion chamber 2, and are mixed in this zone 38. The fuel and oxidant are further mixed by stagnation plate 7. When holes 20 and 20' (and 21 and 21') are not aligned, the fuel/oxidant mixture is not introduced into the combustion chamber 2. This pulsing of the fuel and oxidant time-varies the gaseous flow fields. As with all the other embodiments illustrated herein, these pulses are advantageous because the combustion time is shortened, which tends to reduce the levels of thermal $NO_x$. Also, the pulsing strengthens the fluid dynamic structure 8. This advantageously enhances mixing. The speed of rotation of inner cylinder 33, as well as the geometry of the acoustic resonator 32 and the cylinders 33, 34, can be matched so as to create a condition of acoustic resonance. In this case, the acoustic resonance occurs upstream of the combustion chamber 2.

Figure 14:
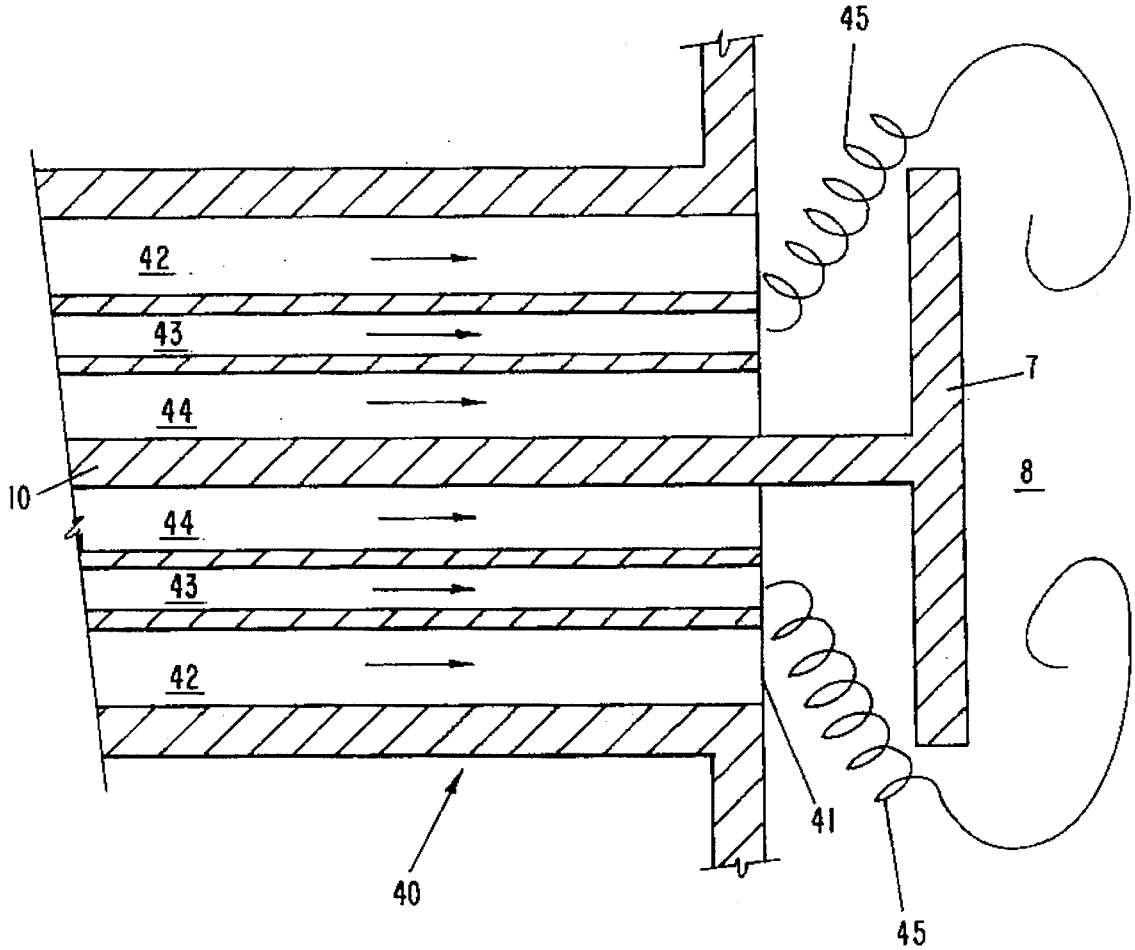
FIG. 14 is a cross-sectional side view of an alternative embodiment of a mixing means 40 of the present invention.

An alternative embodiment 40 of the mixing means and injecting means of the present invention is shown in FIG. 14. A co-axial injection system 40 is comprised of a solid rod 10 placed on the centerline. Rod 10 protrudes beyond the exit plane 41 of the co-axial fuel and oxidizer delivery system 40. Attached to the end of this rod 10 is a stagnation plate 7. Flow past this plate 7 deposits vorticity with a radial component into the flow, creating a coherent toroidal vortex 8. The strength of this toroidal vortex 8 will be, in part, determined by the axial position of the stagnation plate 7. The oxidizer/fuel delivery system 40 is configured as a system of coaxial annular delivery tubes 42,43,44 around the central rod 10. The fuel is delivered by an annular tube 43, with the oxidizer 42,44 existing on both sides of the annular fuel jet 43. The cross-sectional area of each annular jet 42,43,44 is designed so that injection velocity for the oxidizing stream and for the fuel stream are not equal. The injection velocity for both the fuel and oxidizing stream may or may not be periodic in time. This creates a free shear at each interface 45 between the air and oxidizer due to "Kelvin-Helmholtz" instabilities, coherent vertical structures aligned in the azimuthal direction (a radial component of vorticity). These vortex structures 45 entrain the fuel and the oxidizer from each side of the layer into the center. The number and size of these annular injection streams 42,43,44 are determined by the size of the burner, the natural shedding frequency of these structures, the growth characteristics of the shear layer, and its strength. (The design for these co-axial annular jets 42,43,44 can be readily determined from the power output, and fuel type specified by a specific application.) This stratified annular flow is injected past stagnation plate 7. Vorticity with a radial component is shed in the streamwise direction, resulting in a large coherent toroidal vortex 8. The high strain rates created as the reactants accelerate past the stagnation plate 7 suppress the reaction due to fluid dynamic stretch. These high strain rates are a result of large velocity gradients and exist spatially in regions of intense fluid dynamic mixing. The axi-symmetric toroidal vortex 8 that is created by the streamwise deposition of vorticity can be caused to go unstable, resulting in a cascade of energy from large scale to fine scale motion, providing further microscopic mixing of the fuel and oxidizer. This can be induced by one or more of the following mechanisms: 1) Enhancing the natural eigenvalue breakdown mode of the toroidal vortex 8 by creating spatially uniform lobes in the toroidal vortex 8 equal in number to the eigen breakdown value (i.e., making stagnation plate 7 starred, with 6 to 8 lobes). 2) Causing the axial deposition of vorticity to be of unequal strengths in the azimuthal direction (for example, making an elliptically shaped stagnation plate 7). This will cause the axial vorticity to compete in the azimuthal direction. The vortex will undulate in the radial direction, systematically changing the azimuthal orientation of the major and minor axis. 3) Introducing a radial component of vorticity in the flow (i.e., placing swirl generators 28 upstream of the stagnation plate 7). Accelerating the swirling flow past the stagnation plate 7 stretches the radial vorticity component and, due to conservation of angular momentum, the rotational velocity will increase and the spatial region of influence will decrease. This is the identical phenomenon to an ice skater increasing the rate of spin by placing the body's extremities near the axis of rotation. The increase in local circulation results in a more efficient transfer of energy from the large scale to the fine scale, causing a more rapid and thorough microscopic mixing of the fuel and oxidizer.

The present invention does not require an acoustic resonant condition, either upstream or downstream of the combustion region 2. An acoustic resonance may be advantageous in some applications and disadvantageous in other applications. The FIG. 1 embodiment advantageously uses a flow in acoustic resonance to drive the periodic injection process. In the mechanically driven injection embodiments (FIGS. 11 and 12), an acoustic resonance may or may not be employed. If employed, it may be located either upstream or downstream of the combustion region 2, depending upon the application. The same mixing characteristics can be created with or without flows in acoustic resonance.

Safety is preserved in the present invention by mixing the reactants in a fluid dynamic flow field incapable of supporting combustion. Thorough mixing of the reactants with any ambient fluid (acting as a diluent, dropping temperature, and/or as an ignition source), controls the combustion fluid dynamics, optimizing the combustion process of choice. One important result is to optimize for the minimum emission of harmful pollutants ($NO_x$ and CO). In the case of flashback (an undesired condition from a safety standpoint), a benign diffusion flame is stabilized at the face of the mixing valve 11, 29, 33 without the possibility of an explosion, because a minimum of premixed reactants are present at any one given time.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

$NO_x$ and CO Emissions from a Pulse Combustor Operating in a Lean Premixed Mode†

J. O. Keller, T. T. Bramlette,
P. K. Barr and J. Alvarez
Combustion Research Facility
Sandia National Laboratories
Livermore, CA 94551-0969 USA

ABSTRACT

Emission levels below 5.0 ppm $NO_x$, with corresponding levels of 5.0 ppm CO (corrected to 3% $O_2$), were achieved in a pulse combustor operating in a lean premixed mode. Both $NO_x$ and CO concentrations were found not to be a function of the power input.

† This work was supported by the U.S. Department of Energy, Office of Industrial Technologies, Advanced Industrial Concepts Division.

INTRODUCTION

Pulse combustors are known to have relatively low $NO_x$ emission (34-46 ppm compared to 58-138 ppm for conventional boilers[1]). However, current regulations require $NO_x$ emission levels below that produced from current pulse combustor designs (South Coast Air Basin Rule 1109 for industrial process heaters is approximately 23 ppm at 3% $O_2$[2]).

Motivated by increasingly stringent regulations and the emergence of competing technologies[2–5] there have been several efforts to reduce $NO_x$ emissions from pulse combustors. Using flue gas recirculation, $NO_x$ levels have been reduced to between 20 and 25 ppm in a Helmholtz-type pulse combustor with nominal capacities of 147 to 220 kW respectively.[6] The use of air and fuel staging have also been successful in reducing $NO_x$ emissions. $NO_x$ concentrations of about 23 ppm (at 3% $O_2$) have been achieved in an aerovalved Helmholtz-type test burner.[7] These contemporary efforts have applied conventional $NO_x$ reduction technologies to reduce $NO_x$ emissions in pulse combustors with good success, however, the levels achieved are still too high to meet the stringent $NO_x$ emission standards of the South Coast Basin.

Pulse combustion has many inherent features that make the realization of ultra-low $NO_x$ emission possible. The pulse combustor is one example of an acoustically modified combustion process where a periodic injection causes reactants to mix with residual combustion products and subsequently ignite. When the injection and combustion processes are suitably timed to the acoustics, a flow in acoustic resonance may develop, as is the case in pulse combustors. The mechanism responsible for the inherently low $NO_x$ emission levels from pulse combustors has been shown to be a short residence time at high temperature caused by rapid mixing with cooler residual gases.[8] † Other work on the fundamental mixing and combustion characteristics of the pulse combustor has shown that the reactants mix with the residual products in a highly strained flow field, preparing these reactants for combustion to occur in an almost well-stirred manner.[9–12] It has also been shown that this mixing and subsequent combustion process is readily controllable.[13–15] Ultra-low values of $NO_x$ are attainable through the control of the combustion characteristics that lead to $NO_x$ production.

This paper presents $NO_x$ and CO emissions measurements obtained in a Helmholtz-type pulse combustor in which control over the combustion fluid dynamics is used to reduce emissions. By controlling the combustion process we were able to achieve low concentrations of $NO_x$ through two mechanisms: reducing combustion temperatures (minimizing thermal NO), and reducing the residence time at high temperature (minimizing thermal NO and the contribution due to super-equilibrium O and OH).

---

† Note: these values are without the use of any additional $NO_x$ reduction technology (see Ref. 8).

FACILITY and DIAGNOSTICS

Combustor

Figure 1 presents a schematic of the facility used in this study. A one-way valve (flapper valve) is located in the reactant supply line just upstream of the square cross-section combustion chamber (80 mm square by 100 mm long). This valve opens and closes depending on the flow direction of the reactants from the supply line into the combustion chamber.† The combustor was operated in a premixed mode where the fuel (99.99% methane) and air were mixed upstream of the combustion chamber. The injection system was configured so that the reactants were injected axially into the combustion chamber (with an inlet pipe diameter of 20.7 mm), creating an axisymmetric velocity and temperature field. The reactants impinge on a stagnation plate, located on the centerline at a streamwise position of $x$ = 12.0 mm and having a diameter of 19.1 mm. The square cross-section combustion chamber was connected to a square cross-section contraction section that joins the combustion chamber to the 880 mm tailpipe.

Operating Conditions and Diagnostics

The combustor was operated in a premixed mode; the equivalence ratio was varied from $\phi = 0.66$ to $\phi = 1.0$, and mass flow rate ranged from $\dot{m} = 3.9$ g/s to 6.16 g/s. These ranges of both $\phi$ and $\dot{m}$ resulted in the power output ranging from 7.4 to 16.8 kW. These operating conditions caused the cycle time ($\tau_{cycle}$) to range from 3.3 to 13.9 ms. The combustion chamber was equipped with a smooth stagnation plate whose axial position was variable. This provided a method of controlling the rate of vorticity deposition into the combustion chamber. During the injection phase of the cycle the vorticity shed in the combustion chamber creates a well-defined coherent toroidal vortex.[10] This vortex rapidly mixes the reactants with residual products in a high-strain field that suppresses the ignition of these reactants until the combustion chamber pressure rises, which slows the injection of reactants, decreases the strain field, and allows the reactants to ignite.[10–13] The structure of this toroidal vortex governs the rate of macroscopic mixing. Three different flow fields were studied in this work to investigate the effects of different microscopic mixing rates on $NO_x$ and CO emissions. A smooth stagnation plate located at a fixed position determined the base case. The smooth stagnation plate was replaced with a starred plate to create the second flow field. This plate was carefully designed to excite the natural fine-scale three-dimensional breakdown of the coherent toroidal vortex, thereby accelerating fine-scale three-dimensional microscopic mixing. The third microscopic mixing configuration used the smooth plate in conjunction with a swirl generator located upstream of the combustion chamber. The addition of swirl also accelerates the fine-scale three-dimensional breakdown of the coherent toroidal vortex.[16]

† The valve opens to allow reactants into the combustion chamber and closes to prevent reactants from flowing into the supply lines.

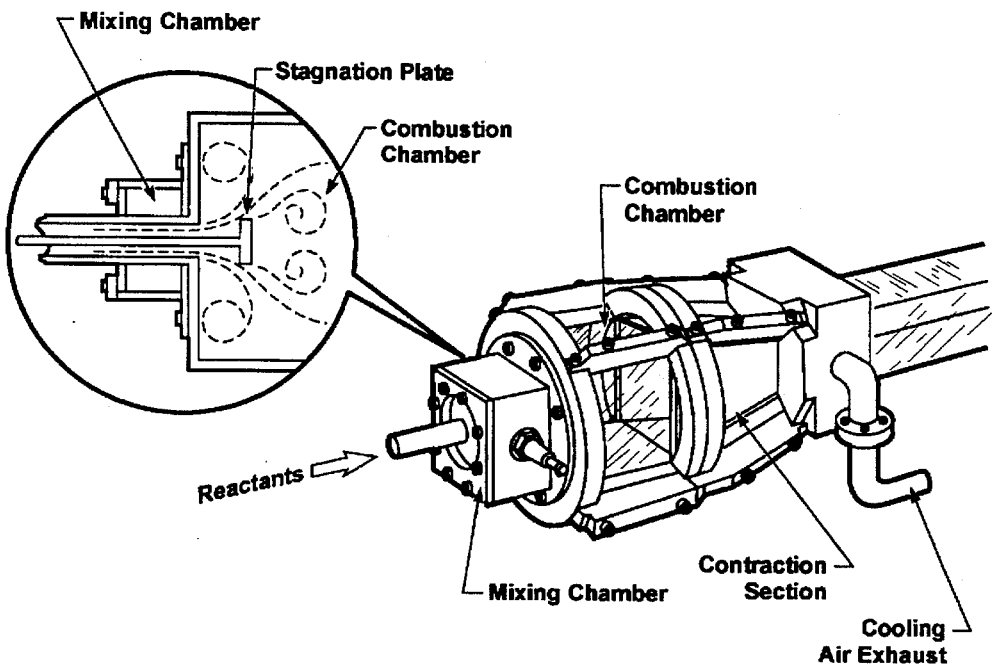

Figure 1. Schematic of the valved pulse combustor showing the injection geometry.

Measurements of NO and $NO_x$ concentrations were made with a chemiluminescent analyzer, measurements of CO concentration were made using a non-dispersive infrared analyzer, and $O_2$ concentrations were determined by a magnetic susceptibility analyzer. Span gases at 8.5 ppm NO, 100 ppm CO and 10% $O_2$ were used for calibration. The $NO_x$ sample line was heated to prevent the water in the combustion products from condensing before reaching the detector. The samples were extracted in the tailpipe 750 mm from the combustion chamber. This location was sufficiently far downstream of the reaction zone to assure that all relevant reactions had achieved steady state. The data presented here have been corrected to 3.0% $O_2$.

DATA PRESENTATION

Shown in Fig. 2 are $NO_x$ and CO concentration measurements taken using the smooth circular stagnation plate and no swirl. This condition will be referred to as the base case. This stagnation plate was placed 12.0 mm into the combustion chamber. Both the equivalence ratio and the total reactant mass flow rate were varied. Shown as points are all the data obtained for this fluid dynamic mixing condition; while the line is a cubic spline fit through the average of the reactant mass flow rate data for each equivalence ratio. As shown in the figure the $NO_x$ concentrations increases monotonically from 2.5 ppm to 32 ppm as $\phi$ increases from 0.68 to 1.0. In addition, the $NO_x$ concentrations are essentially invariant with mass flow rate. Only at the lowest mass flow rates of 3.9 and 4.35 g/s and $\phi$ near 1.0 do the $NO_x$ concentrations increase with an increase in flow rate. At lower equivalence ratios no systematic trend with mass flow rate is noted in these data.

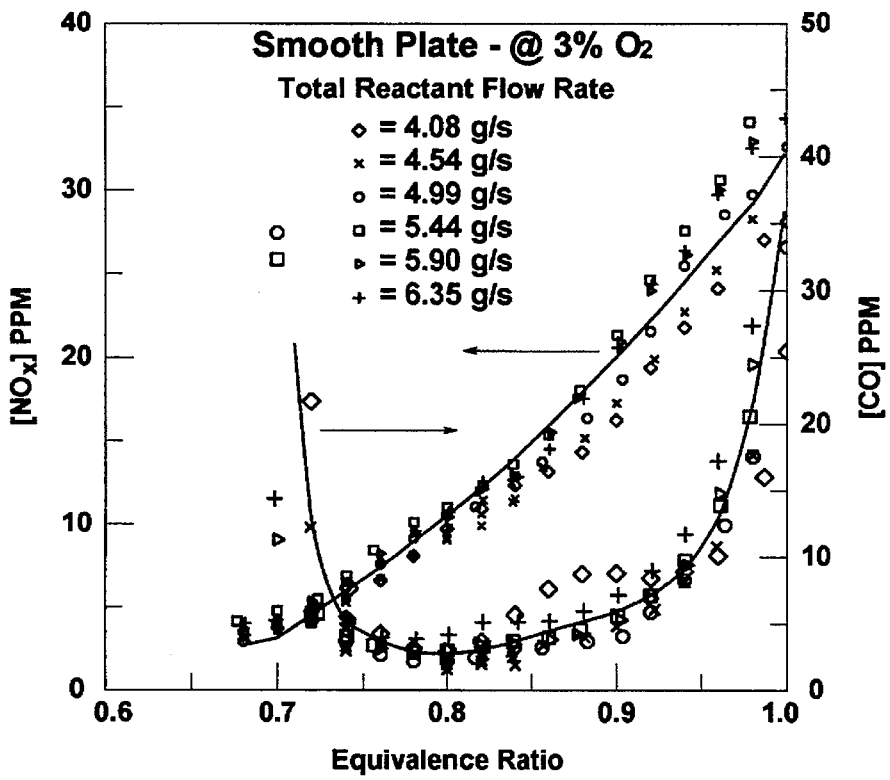

Figure 2. $NO_x$ and CO measurements corrected to 3% $O_2$ taken in the exhaust of the pulse combustor operating at the base case conditions, using a smooth stagnation plate. Shown are data for varying total mass flow rates as a function of equivalence ratio. The larger point size is used for CO concentrations and the smaller point size is used for $NO_x$ concentrations.

Shown also are CO concentration measurements. CO decreases with increasing equivalence ratio to about $\phi = 0.75$ where CO becomes approximately constant at 5 ppm, resulting in CO burnout. Similar to $NO_x$ emission, no systematic trend in CO concentration is noted with changes in the total reactant mass flow rate.

The circular stagnation plate was replaced by a modified stagnation plate in the shape of a 6 pointed star. The starred plate causes the coherent toroidal vortex to breakdown into three-dimensional fine-scale structures more rapidly by exciting the natural cascade of the toroidal vortex.[17] The macroscopic response of the combustor was to decrease the cycle time by about 10%, thus, decreasing the residence time at high temperature. Figure 3 presents $NO_x$ and CO measurements for this fluid dynamic mixing configuration. The trends shown in Fig. 3 are similar to those of the base case in that $NO_x$ monotonically increases with increasing $\phi$, and CO decreases rapidly leveling out to a value of about 5 ppm.

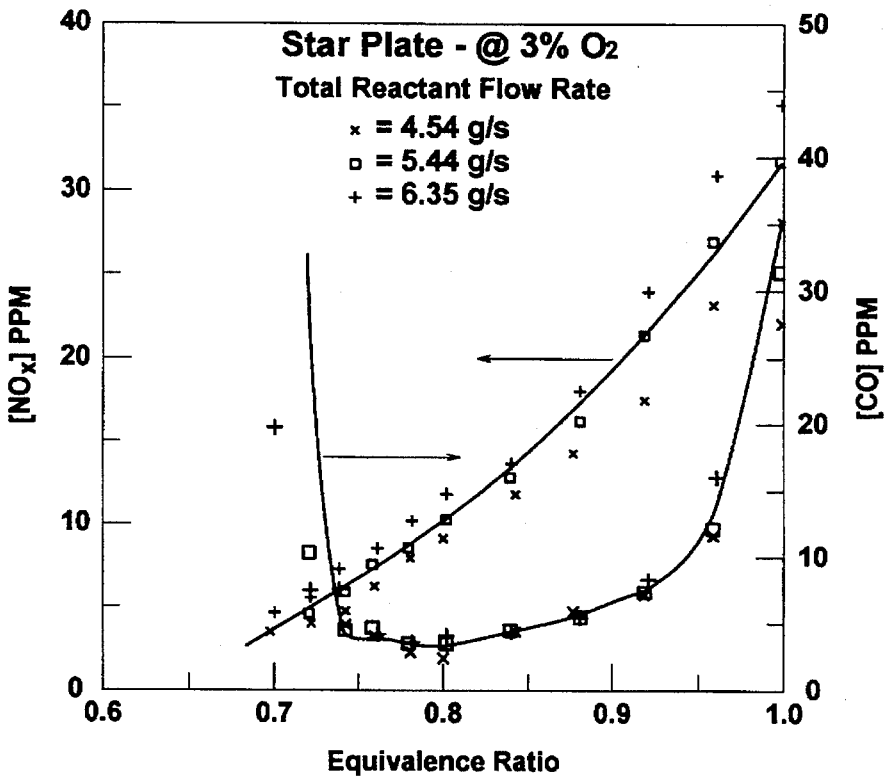

Figure 3. $NO_x$ and CO measurements corrected to 3% $O_2$ taken in the exhaust of the pulse combustor operating with a star stagnation plate. Shown are data for varying total mass flow rates as a function of equivalence ratio. The larger point size is used for CO concentrations and the smaller point size is used for $NO_x$ concentrations.

Another way to affect a more rapid breakdown of the coherent toroidal vortex is to superimpose a vorticity component in the streamwise direction. This was accomplished by adding swirl to the inlet jet. As the vorticity in the streamwise direction is stretched by the creation of the coherent toroidal vortex, the vorticity transport tangential to the toroidal vortex is enhanced, and so is the fine-scale mixing. The result of this vorticity transport is to cause the three-dimensional breakdown of the coherent vortex element to occur more rapidly. As with the starred stagnation plate, the combustor responded by decreasing the cycle time by about 10% from the base case. Shown in Fig. 4 are the $NO_x$ and CO emission data obtained under these fluid dynamic mixing conditions. These data are remarkably similar to those shown in Fig. 3. Indeed, within the precision of these data there is no discernible difference between the data obtained using the star stagnation plate and the data obtained with a swirling inlet.† However, there is a systematic decrease in $NO_x$ levels when comparing these data with the data for the base case shown in Fig. 2.

DISCUSSION $NO_x$ production in natural gas flames is due to four primary mechanisms†: 1) thermal $NO_x$ (the Zeldovich mechanism), 2) increased NO production due to super-equilibrium O and OH, 3) NO due to chemical kinetics with $CH_x$ leading to HCN as a precursor to NO (the Fenimore mechanism), and 4) a three body recombination reaction involving $$O + N_2 + M \rightarrow N_2O + M \tag{1}$$

and the subsequent reaction $$N_2O + O \rightarrow NO + NO. \tag{2}$$

Following Bowman,[2] prompt NO is defined here as the NO production that occurs at a rate faster than that created by the Zeldovich mechanism. So, for this work mechanisms 2, 3 and 4, listed above, are all considered to be prompt NO. The three reactions that comprise the Zeldovich mechanism are:

$$O + N_2 \rightarrow NO + N$$
$$k_3 = 1.9 \times 10^{14} \exp(-38{,}379/T) \tag{3}$$

$$N + O_2 \rightarrow NO + O$$

† Indeed, the data was so similar only enough data was obtained in this case to quantify any differences between the swirl and starred cases. As noted above no significant differences were noted, hence, there was no need for further data.

† See Refs. 2 and 18 for excellent discussions of $NO_x$ production mechanisms.

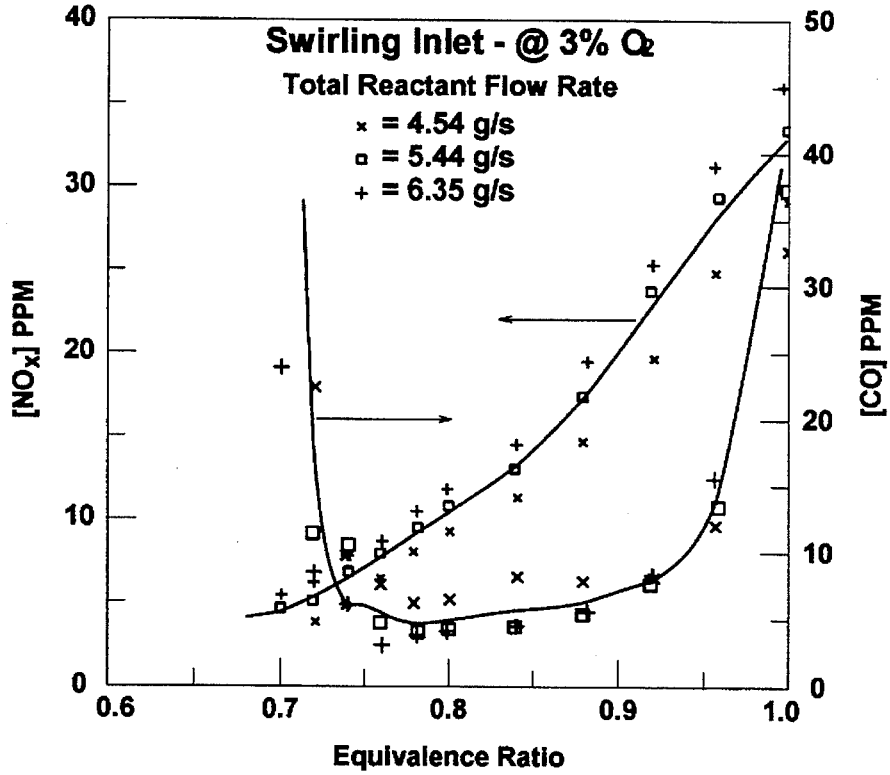

Figure 4. $NO_x$ and CO measurements corrected to 3% $O_2$ taken in the exhaust of the pulse combustor operating with inlet velocity swirling. Shown are data for varying total mass flowrates as a function of equivalence ratio. The larger point size is used for CO concentrations and the smaller point size is used for $NO_x$ concentrations.

$$k_4 = 6.4 \times 10^9 \exp(-3{,}161/T) \tag{4}$$

$$N + OH \rightarrow NO + H$$
$$k_5 = 3.8 \times 10^{13} \tag{5}$$

Here $k_i$ is the specific reaction rate constant and T is the temperature in K. Due to the high activation energy, reaction (3), is the rate-limiting step. By assuming a steady-state concentration for the N-atom and assuming the O-atom concentration is in equilibrium, the maximum NO formation rate due to the Zeldovich mechanism can be expressed by[2]

$$d[NO]/dt = [O_2]^{1/2}[N_2]1.45 \times 10^{17}\, T^{-1/2} \exp[-69{,}460/T(K)]\ mol/(cm^3\ s) \tag{6}$$

here [] denote concentrations in moles/cc. As shown in (6) the production rate of NO due to the Zeldovich mechanism is an exponential function of temperature and linear in residence time. In addition, due to the large activation energy (69,460 K), NO due to the Zeldovich mechanism is a slow reaction.[19]

This combustor was operated lean premixed and at a nominal pressure of 100 kPa. Due to the rapid and thorough mixing resulting from the toroidal vortex, combustion occurs in an almost well-stirred fashion.[10–12] Under lean conditions prompt NO formation can be assumed to be dominated by super-equilibrium O and OH and the three-body recombination reaction involving $N_2O$. As the equivalence ratio approaches stoichiometric conditions, contributions to prompt NO from the Fenimore mechanism become increasingly important.[18] In addition, as the combustion temperature increases as a result of increasing equivalence ratio, the contribution to NO production from the Zeldovich mechanism increases dramatically. At equivalence ratios approaching 1.0, NO from both the Fenimore mechanism and from the Zeldovich mechanism are important.

As shown in Figs. 2, 3 and 4, the concentration of $NO_x$ and CO are functions of equivalence ratio and not systematic functions of the total reactant mass flow rate. Recall that under conditions of operation for this combustor, at high equivalence ratios (high combustion temperature) $NO_x$ production will be primarily controlled by the Zeldovich mechanism, and at low equivalence ratios (low combustion temperature) the $NO_x$ production will be primarily due to super-equilibrium O and OH concentrations and the $N_2O$ mechanism. Since this combustor is operating in a premixed mode, the combustion temperature is fixed by the equivalence ratio and the degree of fine-scale mixing with the residual products.

Comparison between different fluid mixing characteristics is shown in Fig. 5. Only the cubic spline fits to the data presented in Figs. 2, 3, and 4 are shown. Once the combustion temperature has increased sufficiently ($\phi = \geq 0.75$) to cause CO burnout, all of these data are similar.

Measurements of CH concentrations using planar laser induced fluorescence show that the physical structure of the peak concentrations of CH are invariant with changes to the fluid dynamic mixing characteristics.[16] The $NO_x$ levels are also invariant with changes in the rates of fine-scale mixing. Previous work has shown that the residence time at high temperature is short resulting in lower overall NO production, however, the decrease in NO levels with an increase in the microscopic mixing (a decrease in residence time) was not detected here. The expected decrease in NO production due to an increase in fine scale mixing (resulting in a 10% decrease in residence time) for equivalence ratios near one was only 3 ppm which is within the scatter of the data. At equivalence ratios near 0.74 the 10% expected drop in NO concentration was on the order of 0.3 ppm which is also within

---

† Note as the mass flow rate increases at a given equivalence ratio the total energy output increases. This causes the overall system temperature to increase due to a balance between the energy released during combustion and the rate of heat transfer to the surroundings.

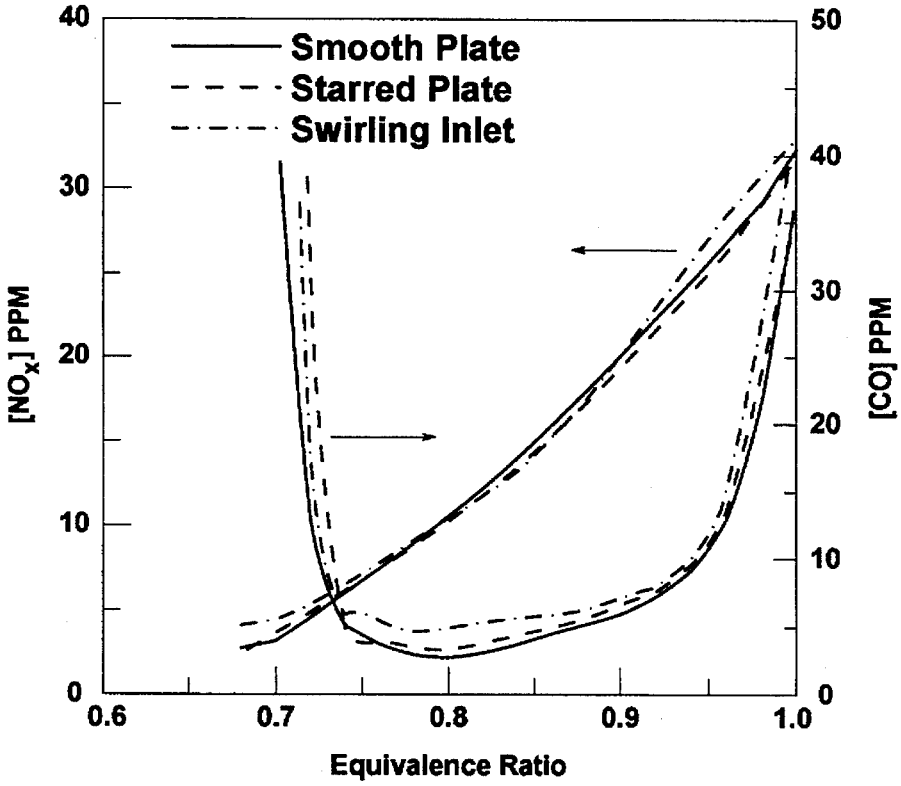

Figure 5. Comparison between different microscopic mixing characteristics of $NO_x$ and CO measurements corrected to 3% $O_2$.

the scatter of the data. As the equivalence ratio decrease the combustion temperature decreases, and as a result of the exponential dependence of thermal NO on temperature, thermal NO production decreases exponentially leaving only the prompt mechanisms (HCN and $N_2O$). In keeping with Bowman,[2] at these low $NO_x$ production levels, emissions may be prompt-limited (HCN and $N_2O$).

SUMMARY

Measurements of $NO_x$ and CO were obtained from a Helmholtz-type pulse combustor operating in a lean premixed mode. Data were obtained over a wide range of operating conditions, including equivalence ratio and total reactant mass flux, and the injection geometry that controls the rate of fine-scale fluid dynamic mixing. It was found that by carefully controlling the combustion temperature and the residence time at high NO production conditions, ultra-low values of $NO_x$ and CO ( $\leq 5$ ppm for $NO_x$ and CO at 3% $O_2$), can be obtained.

Control of the combustion was obtained by operating the combustor lean premixed, by controlling the rate and direction of vorticity deposition into the combustion chamber, and by accelerating the natural cascade of the toroidal vortex to fine-scale three-dimensional motion. Controlling the fluid dynamic microscopic mixing characteristics through the vorticity field provides control over the residence time under high NO production conditions. The decrease in thermal NO levels with an increase in the microscopic mixing was not detected in these measurements. The expected decrease in NO production due to an increase in fine scale mixing (resulting in a decrease in residence time) was on the order of 10% which is within the scatter of the data. The peak concentrations of CH is invariant with microscopic mixing and thus, the production of NO by either the HCN or the $N_2O$ mechanisms is assumed to be invariant with the changes in microscopic mixing created here. Indeed, it is likely that the NO production at these levels is limited by either the HCN or the $N_2O$ mechanisms, or both.

By designing and controlling the combustion process to minimize emission levels, ultra-low values of $NO_x$ and NO (as low as 2.9 ppm and 2.8 ppm, respectively) have been achieved. Operating the combustor at a sufficiently high equivalence ratios to force CO burnout ($\phi$ = 0.74) results in 2.9 ppm of CO and 5.2 and 5.0 ppm of $NO_x$ and NO levels, respectively.

ACKNOWLEDGEMENTS

We thank Steven Vosen for helpful discussions throughout the execution of this work. This work was performed at the Combustion Research Facility, Sandia National Laboratories and supported by the U.S. Department of Energy, Office of Industrial Technologies, Advanced Industrial Concepts Division.

REFERENCES

1. Corliss, J. M., A. A. Putnam, M. J. Murphy, and D. W. Locklin, presented at the *105th ASME Winter Annual Meeting*, New Orleans, La., Paper No. 84-JPGC-APC-2, Dec. 1984.

2. Bowman, C. T., "Control of Combustion-Generated Nitrogen Oxide Emission: Technology Driven by Regulation," Invited Lecture at *Twenty-Fourth Symposium (International) on Combustion* The Combustion Institute, 1992/pp. 859-876.

3. Minden, A. C., and P. T. Gilmore, "$NO_x$ Control in Gas-Fired Refinery Process Heaters Using Pyrocore Radiant Burners, Paper 88-74 WSS/CI, October, 1988.

4. Kesselring, J. P., W. V. Krill, H. L. Atkins, R. M. Kendall, and J. T. Kelly, "Design Criteria for Stationary Source Catalytic Combustors, U.S.E.P.A. Report EPA-600/7-79-181, 1979.

5. Yang, S. C., J. H. Pohl, S. J. Bortz and R. J. Yang, "Commercial Demonstration of a Gas-Fired Burner at 10 ppm," Paper 92-42 WSS/CI, March, 1992.

6. Michel, Y., F. E. Belles, "Effects of Flue-Gas Recirculation on $NO_x$ Production and Performance of Pulse Combustion Hot-Water Boilers, *Proceedings of the International Symposium on Pulsating Combustion,* Monterey, CA Aug. 1991.

7. Kelly, J., "Reducing Gas-Fired Pulse Combustor $NO_x$ Emission," *Proceedings of the International Symposium on Pulsating Combustion,* Monterey, CA Aug. 1991.

8. Keller, J. O., and I. Hongo, "Pulse Combustion: The Mechanisms of $NO_x$ Production," Combust. Flame, 80: 219-237, 1990.

9. Keller, J. O., P. K. Barr, "Premixed Combustion in an Oscillating/Resonant Flow Field. The Influence of Fine Scale Turbulence," *Proceedings of the International Symposium on Pulsating Combustion,* Aug. 1991.

10. Keller, J. O., R. S. Gemmen and P. K. Barr, "Premixed Combustion in an Oscillating/Resonant Flow Field. Part I: Experimental Investigation," *Fall Meeting of the Western States Section/The Combustion Institute,* (1990), *ASME Winter Annual Meeting,* Nov. 25-30, (1990), Dallas, TX.

11. Barr, P. K., and J. O. Keller, "Premixed Combustion in an Oscillating/Resonant Flow Field. Part II: Modeling the Periodic Reacting Flow," *Fall Meeting of the Western States Section/The Combustion Institute,* (1990), *ASME Winter Annual Meeting,* Nov. 25-30, (1990) Dallas, TX..

12. Barr, P. K., and J. O. Keller, "Premixed Combustion in an Oscillating/Resonant Flow Field. Part III: The Importance of Flame Extinction by Fluid Dynamic Strain," *Proceedings of the International Symposium on Pulsating Combustion,* Aug. 1991.

13. Barr, P. K., J. O. Keller, T. T. Bramlette, C. K. Westbrook, and J. E. Dec, "Pulse Combustor Modeling: Demonstration of the Importance of Characteristic Times," Combust. Flame, 82: 252-269 (1990).

14. Keller, J. O., T. T. Bramlette, P. K. Barr, L. Evens, R. Marchant, "Pulse Combustion: Dem- onstration of the Characteristic Mixing Time in a Commercial Burner" Combust. Sci. and Tech., 1989, Vol 66, pp 127-137.

15. Bramlette, T. T. and J. O. Keller, "Method and Apparatus for the Control of Fluid Dynamic Mixing in Pulse Combustors", U. S. Patent No. 5118281, June 2, 1992.

16. Keller, J. O., L. L. Smith, and R. W. Dibble, "Phase Resolved PLIF Measurments of CH in a Strongly Oscillating Flow Field," Poster presentation at *The Twenty Fourth Symposium (International) on Combustion,* The Combustion Institute, Syndey Australia, July 1992.

17. Lasheras, J. C., Liñán, A. Lecuona, A., and Rodriquez P., "Voticity Dynamics in Three-Dimensional Pulsating Co-Flowing Jet Diffusion Flames," *Twenty-Fourth Symposium (International) on Combustion,* The Combustion Institute, 1992, pp 325.

18. Miller, J., C. T. Bowman, "Mechanism and Modeling of Nitrogen Chemistry in Combustion," Prog. Ener. Combust. Sci, 15(4):287-338 (1989).

19. Drake, M. C., and R. J. Blint, General Motors Research Laboratories Report GMR-5800, May 8, 1987.

Safe l Benign Controlled Premixed Bu Design

Resulting in Ultra-Clean Combustion of Gaseous Fuels for Residential, Commercial, Industrial and Utility Applications

J. O. Keller, T. T. Bramlette and P. K. Barr

Motivation

Control of oxides of nitrogen ($NO_x$) and carbon monoxide (CO) resulting from combustion has always been very important, particularly since these pollutants are involved in the atmospheric and photochemical reactions that contribute to ozone formation and photochemical smog. As the provisions of the 1990 Amendments to the Clean Air Act become enacted, specifically the regulations detailed in Title I, control of $NO_x$ and CO becomes even more important. Regulations for boilers of $NO_x$ emissions are currently between 30 and 40 ppm (corrected to 3% oxygen, $O_2$) with provisions to lower the limits even more. As noted by Londervill and White*

> "... Current boiler technology can reduce $NO_x$ to 30 ppm in most boilers using flue-gas recirculation. The resultant CO emissions at these low $NO_x$ levels can range from near zero to greater than 400 ppm depending on a variety of site-specific factors. However, local permitting agencies sometimes impose very low CO limits – below 100 ppm. ..."

Although the regulations for $NO_x$ emission are between 30 and 40 ppm, the California South Coast Basin will not consider issuing a boiler permit unless the boiler produces less than 20 ppm $NO_x$.** *An energy conversion technology that produces a minimum of $NO_x$ from a combusting source without sacrificing energy efficiency or increasing other pollutant emissions is desperately needed.*

In addition to pollutant formation, controlling the combustion process is of paramount importance for eliminating the emissions of Air Toxics as specified in the 1990 Amendments to the Clean Air Act. This is of major concern to the incineration community and to the petroleum industry. The petroleum industry is subject to extraordinarily stringent regulations regarding the emission of Air Toxics from the combustion of "refinery fuel gas" (RFG). Refinery fuel gas is a product of the refining of petroleum, and is the refinery's principle source of energy. If the Air Toxics issue cannot be adequately resolved using RFG, the petroleum industry will be forced to change fuel sources to "Clean Burning" natural gas, which in-and-of-itself may not be all that "Clean". Such a change would represent a gross waste of fuel (RFG) and would be extraordinarily expensive since the industry would have to purchase natural gas. Moreover, to replace RFG with natural gas introduces a new hazardous waste, RFG, that will have to be discarded at additional expense.

---

* Quote taken from "Understand Limits on Reducing both $NO_x$, CO Emissions," by S.B. Londervill and J.H. White, Coen Co. Inc., *Power* July 1992.

** Private communication, Forbes Energy Engineering.

Description

Fundamentally, the mechanisms for producing $NO_x$ (NO, $NO_2$, and $N_2O$, with NO being the major contributor) are known. $NO_x$ is produced through three principle mechanisms: (1) the Zeldovich mechanism, or thermal $NO_x$, (2) the Fenimore reaction, or prompt NO, and (3) NO from fuel-bound nitrogen, typically found in coals. In gaseous fuels ($CH_4$, $C_2H_6$, $C_3H_8$, $H_2$ etc.) the production of fuel-bound $NO_x$ and $N_2O$ is nonexistent. The Zeldovich mechanism is a particularly slow reaction and one that has an exponential dependence on temperature. To limit production of $NO_x$ from the Zeldovich mechanism, one needs to limit the temperature of the combustion, and limit the residence time of $N_2$ and $O_2$ at high temperature. The Fenimore reaction is quite complex, involving detailed chemical kinetic mechanisms. However, CH is a precursor for these reaction kinetics. The concentration of CH increases significantly as the equivalence ratio ($\phi$ = (Fuel/Oxidizer)/(Fuel/Oxidizer at the stoicheiometric ratio)) increases, and the production of NO due to this mechanism becomes significant above $\phi = 0.8$.* The Fenimore reaction is a function of local species concentrations (some of which are very short lived radicals), temperature, and pressure. Thus, if the flow is temporally- or spatially stratified, one could generate local regions of high production of prompt NO even though the overall conditions suggest that prompt NO should be insignificant. Regions of temporally- or spatially stratified equivalence ratios is usually the case resulting in increased levels of NO, however, the present embodiment eliminates these regions of local high NO production due to equivalence ratio stratification.

Ultra-Low $NO_x$ Combustion

While the combustion conditions required to produce very low concentrations of $NO_x$ are clear, how to achieve these conditions safely is not. It is the objective of the present invention to provide a new, safe, environmentally acceptable, high efficiency combustion system for residential, commercial and industrial applications. The combustion process must be controlled so that the following conditions are satisfied: (1) combustion temperatures must be minimized (below 1770 to 1800 K), (2) rapid and thorough mixing of combustion products with cooler fluids must be achieved to limit the residence time (shorter than 4 ms) at combustion temperatures and (3) the local concentration of CH radicals must be minimized for example, one must operate fuel lean.

Unfortunately, the oxidation rate of CO to $CO_2$ is slow and highly temperature dependent; hence, as the combustion temperature is lowered CO concentration increases. A controlled combustion process is needed that (1) operates with a sufficiently high temperature to produce acceptable CO concentrations while minimizing $NO_x$ production, (2) provides a short residence time at combustion temperatures and (3) at the same time minimizes CH concentrations. *A burner operating in a lean premixed mode with a suitably designed fluid dynamic flow field to provide rapid and thorough mixing with cooler residual products of combustion while minimizing the residence time at high temperature provides all of the conditions required for minimizing $NO_x$ production from both the Zeldovich mechanism and the Fenimore*

* See "Mechanism and Modeling of Nitrogen Chemistry in Combustion," by J. A. Miller and C. T. Bowman, *Prog. Ener. Combust. Sci.*, 15(4):287-338 1989.

*reaction while at the sar ne it provides a sufficiently high combi 1 temperature to minimize CO production. Results from our laboratory combustor demonstrate that correct fluid dynamic flow conditions can be created that result in $NO_x$ concentrations as low as 3 ppm (corrected to 3% $O_2$) with a corresponding CO concentration of 5 ppm.

Elimination of Air Toxics

There is ample reason to suspect that Air Toxics may be created as a result of fuel rich regions exposed to high temperature conditions that are then thermally quenched by rapid mixing with cooler gases or by wall impingement. Operating the combustion in a lean premixed mode eliminates the possibility of thermally quenched fuel rich regions, thus eliminating (or at least reducing) the emitted Air Toxics. The current patent description would accomplish this desired goal while also emitting a minimum of $NO_x$ and CO.

Remaining Technical Issues Addressed by this Technology

The significant technical issue remaining is safety. In conventional premixed systems a significant volume is required in order to assure thorough mixing of the fuel and oxidizer. If flashback should occur, the resultant explosion can be hazardous to life and property. Our proposed combustion system provides a mechanism to thoroughly mix the reactants, minimize the volume of premixed reactants, and at the same time provide for the safe treatment of flashback. A new injection system has been designed that accomplishes a thorough mixing of reactants under fluid dynamic conditions (high strain rates) that prohibit combustion.* The fuel and air are introduced at the exit plane of a co-axial injection system. In the case of flashback, the flame would propagate to the exit plane of the burner face where a benign diffusion flame would be established with no possibility of explosion. The mixing of fuel and oxidizer is performed by capitalizing on the rapid and thorough macroscopic mixing of coherent toroidal vortex elements, and the controlled microscopic decay (and subsequent microscopic mixing) of the large scale structures to fine scale structures.

The System

We have designed a new system that controls the combustion process by carefully controlling the mixing of fuel and oxidizer in an environment that prohibits combustion, until such time that combustion can occur safely. The resulting controlled combustion process provides a mechanism to construct lean premixed burners for commercial and industrial heat that produce ultra-low values of $NO_x$ and CO (~4 ppm, corrected to 3% $O_2$), and should eliminate the precursors that produce regulated Air Toxics due to gaseous combustion. The mechanisms utilized to promote macroscopic and microscopic mixing are vortex dynamic instabilities that are controlled by vorticity and momentum transport. When air is used for the oxidizer, the vorticity and momentum transport are dominated by the air side (air mass flow rates are 10 - 20 times those for the fuel) thus, this mixing technology should be fuel type insensitive.

* See "Pulse Combustion: The Mechanisms of $NO_x$ Production," J.O. Keller, I. Hongo, *Combustion and Flame* 80: 219-237 (1990), and Keller, J.O., T.T. Bramlette, P.K. Barr, "$NO_x$ and CO Emissions from a Pulse Combustor Operating in a Lean Premixed Mode," WSS/CI 93-043, Utah, March 22-23, 1993. Submitted to *The Twenty-Fifth Symposium (International) on Combustion*, The Combustion Institute, Pittsburgh, PA, 1994.

** See the attached figure.

* See the attached drawing.

We claim:

1. A method for safely combusting fuel while achieving low levels of $NO_x$ and CO, said method comprising the steps of:

thoroughly mixing a fuel and an oxidant by providing a barrier to control the flow of fuel and oxidant, wherein upstream of the barrier the fuel and oxidant are injected but do not mix and downstream of the barrier the fuel and the oxidant are allowed to mix, to form a mixture incapable of supporting combustion, in a mixing region that is upstream of the region of combustion, thereby removing spatial and temporal inhomogeneities from the fuel and oxygen mixture; and injecting the mixed fuel and oxidant, in a flow field, into a region where combustion occurs, said injected mixture having a form of a large-scale fluid dynamic structure, in order to obtain rapid macroscopic and microscopic mixing of said mixed fuel and oxidant with residual combustion products, wherein the large-scale fluid dynamic structure is an element of a flow field.

2. The method of claim 1 wherein the fluid dynamic structure is a coherent vortex.

3. The method of claim 2 wherein the fluid dynamic structure is a toroidal vortex.

4. The method of claim 1 wherein the ambient gases are products of combustion.

5. The method of claim 1 wherein the flow field is periodic.

6. The method of claim 5 wherein the periodic flow field is accomplished by varying the volume of an acoustic resonator.

7. The method of claim 5 wherein the periodic flow field is accomplished by providing an acoustic resonance upstream of the region of the combustion.

8. The method of claim 5 wherein the periodic flow field is accomplished by providing an acoustic resonance downstream of the region of the combustion.

9. The method of claim 1 wherein the region of combustion is a combustion chamber of a pulse combustor.

10. The method of claim 1 wherein time-varying the flow field is accomplished by mechanical means.

11. The method of claim 1 wherein the barrier comprises a one-way valve.

12. The method of claim 1 wherein the one-way valve is a flapper valve comprising a single orifice plate and a flapper; wherein opening the flapper causes fuel lines and oxidant lines to open simultaneously; and closing the flapper causes fuel lines and oxidant lines to close simultaneously, thereby removing spatial and temporal inhomogeneities in the fuel and oxidant mixture, and providing for controlling a fuel and oxidizer equivalence ratio.

13. The method of claim 11 wherein:

the one-way valve is a rotating band having slots that pass over fuel ports and oxidant ports, thereby sequentially:

opening said fuel ports and said oxidant ports simultaneously; and closing said fuel ports and said oxidant ports simultaneously.

14. An apparatus for safely combusting a fuel in such manner that very low levels of $NO_x$ and CO are produced, said apparatus comprising:

a first inlet line containing a fuel;

a second inlet line containing an oxidant;

coupled to said fuel line and to said oxidant line, means for spatially and temporally mixing the fuel and the oxidant to form a mixture incapable of supporting combustion;

coupled to the mixing means, means for injecting the mixed fuel and oxidant into a combustion region in a form of a large-scale fluid dynamic structure; and coupled to the combustion region, periodic means within the combustion region for mixing the fuel and oxidant with residual combustion products.

15. The apparatus of claim 14 wherein the periodic means for mixing the fuel and oxidant mixture with residual combustion products comprises a pulse combustor.

16. The apparatus of claim 14 wherein the periodic means for mixing the fuel and oxidant mixture with residual combustion products comprises an acoustic resonator positioned upstream of the region of combustion.

17. The apparatus of claim 14 wherein the periodic means for mixing the fuel and oxidant mixture with residual combustion products comprises an acoustic resonator positioned downstream of the region of combustion.

18. The apparatus of claim 14 wherein the mixing means for mixing the fuel and oxidant comprises a one-way flapper valve having a single orifice plate.

19. The apparatus of claim 14 wherein the mixing means for mixing the fuel and oxidant comprises a rotating band having slots that pass over open ends of said fuel line and said oxidant inlet line simultaneously.

20. The apparatus of claim 14 wherein the injecting means comprises a stagnation plate coaxially aligned with and movable within the combustion region.

21. A one-way flapper precombustion gases mixing valve comprising:

a valve seat containing apertures permitting the flow of precombustion gases therethrough;

a flapper located downstream of said valve seat;

a backer plate located downstream of said flapper;

said flapper being movable between said valve seat and said backer plate;

said backer plate containing apertures for communicating with a chamber comprising said valve seat and said flapper;

said flapper having apertures which permit communication of gases in one direction only, wherein the flapper, in the presence of back pressure, firmly closes off the apertures in the valve seat; and a center rod having a stagnation plate attached thereto downstream of said backer plate, said stagnation plate ensuring the creation of a large scale fluid dynamic structure to rapidly mix the precombustion gases for combustion.

22. A mixing means for thoroughly mixing combustion gases, said mixing means comprising:

a plurality of fuel port apertures;

interspersed among said fuel port apertures, a plurality of oxidizer port apertures; and a rotating band comprising a plurality of slits, wherein each of said slits periodically passes over said fuel port apertures and said oxidizer port apertures.

23. The mixing means of claim 22 wherein said band rotates at a constant speed, and the slits are equispaced within said band, whereby said fuel and oxidant are pulsed through said slits periodically.

24. The mixing means of claim 23 wherein a condition of acoustic resonance is created.

25. A mixing means for thoroughly mixing precombustion gases, said mixing means comprising:

an acoustic chamber;

positioned within the acoustic chamber, a fixed outer cylindrical sleeve containing fuel holes and oxidant holes;

fitting within the outer cylindrical sleeve, an inner cylindrical sleeve having apertures that are longitudinally aligned with said fuel holes and said oxidant holes; and means for rotating said inner sleeve; whereby rotation of said inner sleeve periodically permits the simultaneous passage of fuel and oxidant through said apertures.

26. The mixing means of claim 25 wherein the acoustic chamber is dimensioned to create a condition of acoustic resonance.

27. The mixing means of claim 26 wherein the chamber is pressurized to enhance the resonant effect.

28. The mixing means of claim 25 further comprising an elongated rod coaxially aligned with said two cylindrical sleeves, said rod terminating in a stagnation plate.

29. A mixing means for thoroughly mixing precombustion gases, said mixing means comprising:

a least one cylindrical-sleeve shaped fuel entrance chamber;

coaxially aligned with said fuel entrance chamber(s), at least one cylindrical-sleeve shaped oxidant entrance chamber; and coaxially aligned with said fuel and oxidant chambers, an elongated center rod protruding beyond said chambers and terminating in a stagnation plate.

30. The mixing means of claim 29 wherein said stagnation plate has the shape of a star with between 6 and 8 lobes.

* * * * *